US005123245A

United States Patent [19]

Vilenius et al.

[11] Patent Number: 5,123,245

[45] Date of Patent: Jun. 23, 1992

[54] METHOD AND APPARATUS FOR STARTING A FREE PISTON COMBUSTION ENGINE HYDRAULICALLY

[75] Inventors: Matti Vilenius, Nattari; Kalevi Huhtala; Kari Koskinen, both of Tampere; Erkki Lehto, Päkäne, all of Finland

[73] Assignee: Sampower Oy, Turenki, Finland

[21] Appl. No.: 780,040

[22] Filed: Oct. 21, 1991

[30] Foreign Application Priority Data

Oct. 19, 1990 [FI] Finland ..... 905162

[51] Int. Cl.[5] ..... F02B 71/02

[52] U.S. Cl. ..... 60/596

[58] Field of Search ..... 60/596

[56] References Cited

U.S. PATENT DOCUMENTS 2,731,793 1/1956 Lewis ..... 60/596

2,978,986 4/1961 Carder et al. ..... 60/596 X

*Primary Examiner*—Allen M. Ostrager

*Attorney, Agent, or Firm*—Scully, Scott Murphy & Presser

[57] ABSTRACT

A method of starting a free piston combustion engine is described in which the free piston unit consisting of the combustion pistons and the piston rod connecting them is set in motion by alternately pressurizing the hydraulic cylinder spaces of a double-acting piston and cylinder arrangement whose piston or piston is or are connected to the piston rod. For this purpose pressure from a hydraulic accumulator used for starting the engine is supplied as a control pressure to the check valve members of the one way outlet check valves of the hydraulic cylinder spaces to keep those check valves closed during starting of the engine. This control pressure supplements the spring pressure supplied by springs in the check valves biasing the check valve members towards their closed positions. Simultaneously a directional valve is used to channel hydraulic fluid from the hydraulic accumulator directly to the cylinder spaces in turn, thereby bypassing the one way inlet check valves to the cylinder spaces. In this way the free piston unit is set in motion. Once the free piston has performed a predetermined number of reciprocating movements or has attained a sufficient magnitude of inertial energy the hydraulic accumulator is disconnected so that the inlet and outlet valves can perform their normal function, while simultaneously or just before or just after this moment fuel combustion is initiated to maintain the engine in operation. An electronic controller responsive to signals from sensors mounted on the engine from which can be derived information about the position and speed of the free piston unit can be used to control starting and operation of the engine.

22 Claims, 3 Drawing Sheets

METHOD AND APPARATUS FOR STARTING A FREE PISTON COMBUSTION ENGINE HYDRAULICALLY

FIELD OF THE INVENTION

The present invention relates to a method for starting hydraulically a combustion engine having a freely movable piston. The invention further concerns an apparatus including a freely reciprocating piston unit to which is connected a double-acting hydraulic piston/cylinder device, whose cylinders are connected via one-way pressure-driven check valves, that is, the check valves of the pressure side, to a hydraulic actuator and via one-way suction valves to a hydraulic storage reservoir.

BACKGROUND OF THE INVENTION

The construction and principle of the free piston combustion engine is disclosed in FI-A-80760 and in U.S. Pat. No.-A-4,992,301. Worth mentioning as further references to the conventional technique are U.S. Pat. No.-A-3,089,305, U.S. Pat. No.-A-3,995,974 and U.S. Pat. No.-A-4,097,198.

One of the problems associated with the development of free piston combustion engines has arisen from starting of the engine. According to the method described in U.S. Pat. No.-A-3,995,974, starting is performed using the same hydraulic cylinder-operated apparatus that after starting is used for power output from the engine, and the valve elements, which are included in the hydraulic circuit between the hydraulic accumulator for the starting pressure and the cylinders of the hydraulic piston/cylinder device, are controlled to switch their position so as to cause the opposite sides of the hydraulic piston/cylinder device to be alternately pressurized, while simultaneously allowing the cylinder space opposite to that being pressurized to be connected via a return line to the hydraulic reservoir. Such an arrangement achieves a reciprocating motion in a simple and useful manner without a dedicated hydraulic power source, whereby the engine construction is simplified, the weight is simultaneously reduced and the price minimized.

There remains, however, the need for starting the reciprocating motion of the free piston unit with the help of sufficient inertial energy before the combustion process can be initiated.

Therefore, in many appliances it would be advantageous to be able to use an essentially high pressure as the starting pressure than the pressure available in the pressure accumulator provided between the hydraulic piston/cylinder device and the actuator itself. This is not possible, however, if the pressure of the hydraulic cylinders is allowed also during starting to be imposed over the pressure-driven check valves to the pressure accumulator of the load and the pressure-regulating valve; and further, to the flywheel engine, which is driven by the pressure of the hydraulic cylinders during the normal running of the engine as described in U.S. Pat. No.-A-3,995,974.

A special problem with the last mentioned prior art proposal is that the hydraulic circuit to the load is arranged to be cut off during the starting phase by a separate clutch valve. The clutch valves presently available are, however, too slow to make the necessary ON and OFF switching with the high flow rates and pressures in question.

SUMMARY OF THE INVENTION

The invention seeks to provide a method of starting a free piston combustion engine with such an improvement over prior art techniques that makes it possible to boost and quicken the starting of the engine. It further seeks to provide an improved free piston combustion engine which is easy and quick to start.

According to the present invention there is provided a method for starting a free piston combustion engine hydraulically, in which method starting of the engine is provided by means of the same double-acting hydraulic piston/cylinder device that after the starting of the engine is used for power output from the engine; and in which controlling valve elements are placed in the hydraulic circuit between a hydraulic accumulator of the starting pressure and the cylinders of the piston/cylinder device to switch their position so that the opposite sides of the hydraulic piston become alternately pressurized, while the cylinder space being opposite to the pressurized cylinder space becomes simultaneously connected via a return line to a reservoir, wherein for the duration of the starting the one-way check valves of the hydraulic cylinders are controlled to a closed state, whereby they prevent the flow of the hydraulic fluid away from the cylinder spaces, and during initiation of the combustion process or alternatively, immediately before or after initiation of the combustion process, the check valves are released for normal operation, in which they allow only a one-way flow of the hydraulic fluid, namely away from the cylinders.

Thus, in the method in accordance with the invention, during starting the one way pressure-driven check valves of the hydraulic cylinders are controlled to a closed state, whereby they prevent the flow of the hydraulic fluid from the cylinders, while during starting or immediately before or after starting, the check valves are released for normal operation, whereby they permit only a one-way flow of the hydraulic fluid which is away from the cylinders.

Preferably the one-way check valves are controlled to be closed by the pressure of the hydraulic accumulator of the starting pressure. In one arrangement the position switching of the direction changing valve elements is controlled on the basis of position and speed information issued by position and speed sensors of the free piston unit.

The initiation of fuel injection may be controlled to occur only after the free piston unit has been forced to make a preset number of reciprocating movements, or alternatively, when the free piston unit has attained a sufficient magnitude of inertial energy, and so that, simultaneously with the initiation of fuel injection or alternatively, immediately before or after it, said direction-changing valve elements are controlled to a position in which the connection of one of the cylinder spaces to the hydraulic accumulator of the starting pressure, and respectively, the connection of the other cylinder space to the reservoir are both simultaneously cut off.

The invention further provides an apparatus for starting a free piston engine hydraulically, said apparatus comprising:

a free piston unit with which is associated a double-acting hydraulic piston/cylinder device;

one-way pressure-driven check valves, or the check valves of the pressure side, via which the cylinder spaces of said piston/cylinder device are connected to a hydraulic actuator;

one-way suction valves, via which said cylinder spaces are connected to a hydraulic storage reservoir;

a first set of valve elements in the pressure line between the hydraulic accumulator of the starting pressure and the cylinder spaces of said piston/cylinder device, the first set of valve elements being controllable to change their position so that the opposite sides of the hydraulic piston become alternately pressurized, while the cylinder space being opposite to the pressurized cylinder space becomes simultaneously connected via a return line to the reservoir; and a second set of valve elements for cutting off the hydraulic fluid flow between the cylinder spaces and the actuator for the duration of the starting;

wherein the second set of valve elements include said one-way check valves that are arranged to be controllable during starting by the pressure of the hydraulic accumulator of the starting pressure to a closed state, whereby they prevent the fluid flow from the cylinder spaces to the actuator.

In such an apparatus the hydraulic accumulator of the starting pressure may be connected to said one-way check valves via such valve elements of the second set of valve elements that in their first position control the check valves to a closed state and in their second position release the check valves to allow a one-way fluid flow from the cylinder spaces to the actuator. Moreover the pressure line leading to the actuator can be provided with a low-power hydraulic motor rotating an electric generator and a flushing pump.

Preferably said first and second sets of valve elements are arranged controllable by a controller, which is connected to sensors sensing the speed and position of the free piston unit. Such an electronic controller can be arranged to initiate fuel injection only after the free piston unit has been forced to make a preset number of reciprocating movements, or alternatively, when the free piston unit has attained a sufficient magnitude of inertial energy, and so that, simultaneously with the initiation of fuel injection or alternatively, immediately before or after it, said controller is arranged to control said first set of valve elements to a position in which the connection of one of the cylinder spaces to the hydraulic accumulator of the starting pressure, and respectively, the connection of the other cylinder space to the reservoir are both simultaneously cut off.

It is preferred that the pressure in the hydraulic accumulator of the starting pressure is higher than the pressure in a pressure accumulator connected to a pressure line between the double-acting piston/cylinder device and the actuator.

In another aspect of the invention there is provided a free piston combustion engine comprising:

body means defining a pair of opposed combustion cylinders;

a combustion piston reciprocably disposed in each said combustion cylinder for reciprocal motion therein;

piston rod means connecting said combustion pistons one to another whereby said combustion pistons may reciprocate in unison in their respective combustion cylinders;

hydraulic power output means including at least one pair of hydraulic cylinder spaces having an associated hydraulic piston reciprocably disposed therein, said hydraulic piston being operatively linked to said piston rod so as to reciprocate in unison therewith;

hydraulic accumulator means for storage of hydraulic fluid under elevated pressure for use in starting said engine;

hydraulic inlet check valves for controlling inlet of hydraulic fluid to each said hydraulic cylinder space, said hydraulic inlet check valves each including a first check valve member movable between a first position in which it permits inlet of hydraulic fluid to its respective hydraulic cylinder and a second position in which it prevents inlet of hydraulic fluid thereto;

first hydraulic control means connected between said hydraulic accumulator means and said hydraulic cylinder spaces for controlling flow of hydraulic fluid from said hydraulic accumulator means to said hydraulic cylinder spaces during starting of said engine, said first hydraulic control means including a directional valve means permitting, in one condition thereof, inlet of hydraulic fluid from said hydraulic accumulator means to one of a respective pair of hydraulic cylinder spaces and outlet of hydraulic fluid from the other one thereof and permitting, in another condition of said directional valve means, inlet of hydraulic fluid from said hydraulic accumulator means to said other hydraulic cylinder space of said pair and outlet of hydraulic fluid from said one hydraulic cylinder space of said pair;

hydraulic outlet check valves for controlling outlet of hydraulic fluid from each said hydraulic cylinder space, said hydraulic outlet check valves each including a second check valve member movable between a first position in which it permits outlet of hydraulic fluid from its respective hydraulic cylinder space to an output supply line and a second position in which it prevents outlet of hydraulic fluid from its respective hydraulic cylinder space; and second hydraulic control means connected between said hydraulic accumulator means and said hydraulic outlet check valves arranged to permit application of an elevated control pressure to said second check valve members so as to move them each to its respective said second position to prevent outlet of hydraulic fluid from its associated hydraulic cylinder space during starting of said engine so long as the pressure within said associated hydraulic cylinder space does not exceed said elevated control pressure;

said first hydraulic control means being arranged to permit, during starting of said engine, by repeated switching of said directional valve means between said first and second conditions thereof, hydraulic fluid to enter each of said pair of hydraulic cylinder spaces in turn from said hydraulic accumulator means thereby to impart reciprocal motion to said piston rod and to said combustion pistons so as to produce in said combustion cylinders in turn a desired compression pressure at which combustion can be initiated therein; and said second hydraulic control means being arranged so that, at a predetermined moment after said piston rod together with said pistons begins to reciprocate, said control pressure is removed from said second check valve members to permit outlet of hydraulic fluid from said hydraulic cylinder spaces.

In such a free piston combustion engine said hydraulic power output means may comprise a double-acting piston and cylinder arrangement including a single piston slidable within a common cylinder and dividing said common cylinder into said pair of opposed said hydraulic cylinder spaces; alternatively said hydraulic power output means may comprise a pair of single-acting piston/cylinder pumps in a boxer arrangement.

Said second hydraulic control means can include a control valve having a first inlet connected to said hydraulic accumulator means, a second inlet connected to said output supply line, and an outlet connected to said hydraulic outlet check valves, said control valve including a check valve member movable between a first end position in which it permits communication between said first inlet and said outlet to permit application of hydraulic pressure from the hydraulic accumulator means to said second check valve members to bias them towards their respective second positions and a second end position in which it permits communication between said second inlet and said outlet to permit the pressure on the two sides of the said second check valve members substantially to equalise to permit free movement thereof between their respective said first and second positions.

It is preferred that each said hydraulic outlet check valve further comprises spring means resiliently biasing said second check valve member towards its second position whereby said control pressure is provided by a combination of hydraulic pressure from said hydraulic accumulator means and spring pressure provided by said spring means.

Conveniently said output supply line is provided with a hydraulic motor arranged to drive an electric generator and a flushing pump.

In one form of engine according to the invention said first hydraulic control means and said second hydraulic control means are under the control of an electronic controller which is connected to sensors arranged to sense the speed and position of said free piston unit. Preferably said electronic controller is arranged to initiate fuel injection at a moment which is selected from the moment at which said free piston unit has completed a preset number of reciprocating movements and the moment at which said free piston unit has attained a predetermined magnitude of inertial energy and wherein said electronic controller is arranged to disable said first hydraulic control means and stop switching of said directional valve means between its first and second positions at a second moment selected from said first moment, a moment immediately before said first moment, and a moment immediately after said first moment, thereby to permit said hydraulic cylinder spaces to receive hydraulic fluid via said hydraulic inlet check valve means from a reservoir for hydraulic fluid.

A further pressure accumulator means can be connected to said output supply means and said hydraulic accumulator means can be pressurized to a higher pressure than the pressure in said further pressure accumulator means.

The invention also provides an internal combustion assisted hydraulic engine comprising:

body means defining a pair of opposed combustion chambers;

a combustion piston reciprocably disposed in each said combustion chamber for reciprocal motion therein;

a piston rod rigidly connecting said combustion pistons to cause said combustion pistons to reciprocate in their respective combustion chamber in unison with said piston rod as a free piston unit;

at least one double-acting hydraulic pump comprising a pair of hydraulic cylinder spaces with a hydraulic piston reciprocably disposed therein, said hydraulic piston or pistons being operatively connected to said piston rod to move in unison therewith;

a reservoir for hydraulic fluid;

an output pressure line for supply of hydraulic fluid under pressure to a hydraulic actuator;

hydraulic accumulator means for storage of hydraulic fluid under pressure for starting said engine;

hydraulic inlet check valves for controlling inlet of hydraulic fluid to said hydraulic cylinder spaces, each said hydraulic inlet check valve including a first check valve member movable between a first position in which it permits inlet to its respective cylinder space of hydraulic fluid from said reservoir and a second position in which it prevents inlet of hydraulic fluid to its respective hydraulic cylinder space;

hydraulic outlet check valves for controlling outlet of hydraulic fluid from said hydraulic cylinder spaces, each said hydraulic outlet check valve including a second check valve member movable between a first position in which it permits outlet of hydraulic fluid from its respective hydraulic cylinder space to said output pressure line, and a second position in which it prevents outlet of respective hydraulic fluid from said respective hydraulic cylinder space to said output pressure line;

first hydraulic control means connected between said hydraulic accumulator means and said hydraulic cylinder spaces and including a directional valve means permitting, in one condition thereof, inlet of hydraulic fluid from said hydraulic accumulator means to one hydraulic cylinder space of the or a said pair of hydraulic cylinder spaces and outlet of hydraulic fluid from the other hydraulic cylinder space of the respective pair of hydraulic cylinder spaces to said reservoir and, in another condition thereof, outlet of hydraulic fluid from said one hydraulic cylinder space to said reservoir and inlet of hydraulic fluid to said other hydraulic cylinder space from said hydraulic accumulator means; and second hydraulic control means for applying, during starting of said engine, a hydraulic control pressure to said second check valve members to bias them each towards its respective second position to prevent outlet of hydraulic fluid from its associated hydraulic cylinder space to said output pressure line so long as the pressure biasing said second check valve members towards their respective second positions exceeds the pressure within said associated hydraulic cylinder space;

said first hydraulic control means being arranged so that, during starting of said engine, said directional valve means is repeatedly switched between its first and second positions to pressurize the hydraulic cylinder spaces of the or each said pair of hydraulic cylinder spaces in turn thereby to cause reciprocation of said free piston unit until a desired compression pressure has been achieved in a respective said combustion chamber sufficient to permit initiation of the combustion process therein; and said second hydraulic control means being arranged so that, at a desired instant after said piston unit begins to reciprocate, said hydraulic control pressure is released to permit hydraulic fluid to flow from said hydraulic cylinder spaces to said output pressure line.

In such an internal combustion assisted hydraulic engine said double-acting hydraulic pump means can comprise a piston movable within a common cylinder and dividing said common cylinder into a pair of hydraulic cylinder spaces; alternatively said at least one double-acting hydraulic pump means can comprise a twin set of single-acting piston/cylinder pumps in a boxer arrangement. Such an engine may have in its output pressure line a low power hydraulic motor arranged to drive an electric generator and a flushing pump.

In one preferred embodiment said first hydraulic control means and said second hydraulic control means are arranged to be controllable by an electronic controller which is connected to sensors sensing the speed and position of free piston unit. Thus said electronic controller can be arranged to initiate fuel injection at a first instant which is selected from the instant at which said free piston unit has completed a preset number of reciprocating movements and the instant at which said free piston unit has attained a predetermined magnitude of an inertial energy, said electronic controller further being arranged to disable said first hydraulic control means at a second instant which is selected from said first instant, an instant immediately before said first instant, and an instant immediately after said first instant, thereby to permit hydraulic fluid to be drawn from said reservoir into said hydraulic cylinder spaces via said hydraulic inlet check valves.

Said second hydraulic control means, in one form of engine, includes a control valve having a first inlet which can be placed in fluid communication with said hydraulic accumulator means, a second inlet in fluid communication with said output supply line, and an outlet in fluid communication with said hydraulic outlet check valves, said control valves including a check valve member movable between a first control position in which it permits fluid communication between said first inlet and said outlet to permit application of hydraulic pressure from said hydraulic accumulator means to said second check valve members to bias them towards their respective second positions and a second control position in which it permits communication between said second inlet and said outlet to permit the pressure on the two sides of said second check valve members to equalise to permit free movement thereof between their respective first and second positions and wherein said hydraulic control means further includes means for interrupting communication between said hydraulic accumulator means and said first inlet. In such an engine each said hydraulic outlet check valve preferably further comprises spring means resiliently biasing said second check valve member towards its second position whereby said pressure biasing said second check valve member towards its second position during starting of said engine comprises the sum of said hydraulic control pressure and spring pressure provided by said spring means.

A pressure accumulator means may be connected to said output pressure line, said hydraulic accumulator means being arranged to be pressurized to a higher pressure than said pressure accumulator means.

In accordance with another aspect of the invention there is provided a method of starting an internal combustion assisted hydraulic engine having a pair of opposed combustion chambers, a combustion piston reciprocably disposed in each said combustion chamber and linked one to another by a piston rod to form a free piston unit, at least one double-acting hydraulic pump comprising a pair of hydraulic cylinder spaces with a hydraulic piston reciprocably disposed therein, said hydraulic piston or pistons being operatively connected to said piston rod to move in unison therewith, one way inlet check valves for controlling inlet of hydraulic fluid from a reservoir to said hydraulic cylinder spaces, one way outlet check valves for controlling outlet of hydraulic fluid from said hydraulic cylinder spaces, each said one way valve including a check valve member movable under the influence of a control pressure applied thereto between a first end position permitting flow of hydraulic fluid through said check valve and a second position preventing flow of hydraulic fluid through said check valve, said method comprising the steps of:

providing a hydraulic accumulator means pressurized to an elevated pressure for starting said engine;

connecting said hydraulic accumulator means to said one way outlet check valves so as to apply the pressure prevailing in said hydraulic accumulator means as an elevated hydraulic control pressure to said check valve members thereof to close said one way outlet control valves;

supplying hydraulic fluid from said hydraulic accumulator means to each of said hydraulic cylinder spaces of the or a said respective pair of said hydraulic cylinder spaces in turn thereby pressurize said hydraulic cylinder spaces in turn and to impart a reciprocating motion to said free piston unit; and disconnecting said hydraulic accumulator means from said one-way outlet check valves so as to remove the elevated hydraulic control pressure from said check valve members thereof thereby to permit opening of said one way outlet check valves at a moment selected from a first moment at which the combustion process is initiated, a second moment immediately preceding said first moment, and a third moment immediately following said first moment.

In this method closure of said one-way outlet check valves can be assisted by application of spring pressure from spring means arranged to bias said respective check valve members towards their closed positions.

The step of alternately pressurizing said hydraulic cylinder spaces may include the step of switching a directional valve between end positions permitting flow of hydraulic fluid into one said cylinder hydraulic space and out from the other said hydraulic cylinder space of the or a said pair of hydraulic cylinder spaces while said piston unit is moving in one direction and allowing inlet of hydraulic fluid to said other hydraulic cylinder space and outlet of hydraulic fluid from said one hydraulic cylinder space when said piston unit is moving in the other direction, switching of said directional valve being under control of an electronic controller in dependence upon information about the position and speed of said free piston unit derived by said controller from signals from sensors mounted in the engine.

Initiation of the combustion process in said combustion chambers can be effected after a first predetermined time from initiating starting of said engine, said predetermined time being selected from a time period required for said free piston unit to complete a preset number of reciprocating movements and a time period sufficient for the free piston to attain a predetermined magnitude of inertial energy, and wherein, after a second predetermined time from initiation of the starting procedure, said second time being selected from said first predetermined time interval, a time interval slightly shorter than said first time, and a time period slightly longer than said first predetermined time, the step of alternately pressurizing said hydraulic cylinder spaces from said hydraulic accumulator means is terminated, thereby allowing hydraulic fluid to be drawn from said reservoir into said hydraulic cylinder spaces via said one-way inlet check valves.

DESCRIPTION OF THE DRAWINGS

In the following description the invention is described by way of an exemplifying embodiment with reference to the accompanying drawings, in which.

DESCRIPTION OF SOME EMBODIMENTS OF THE INVENTION

Figure 1:
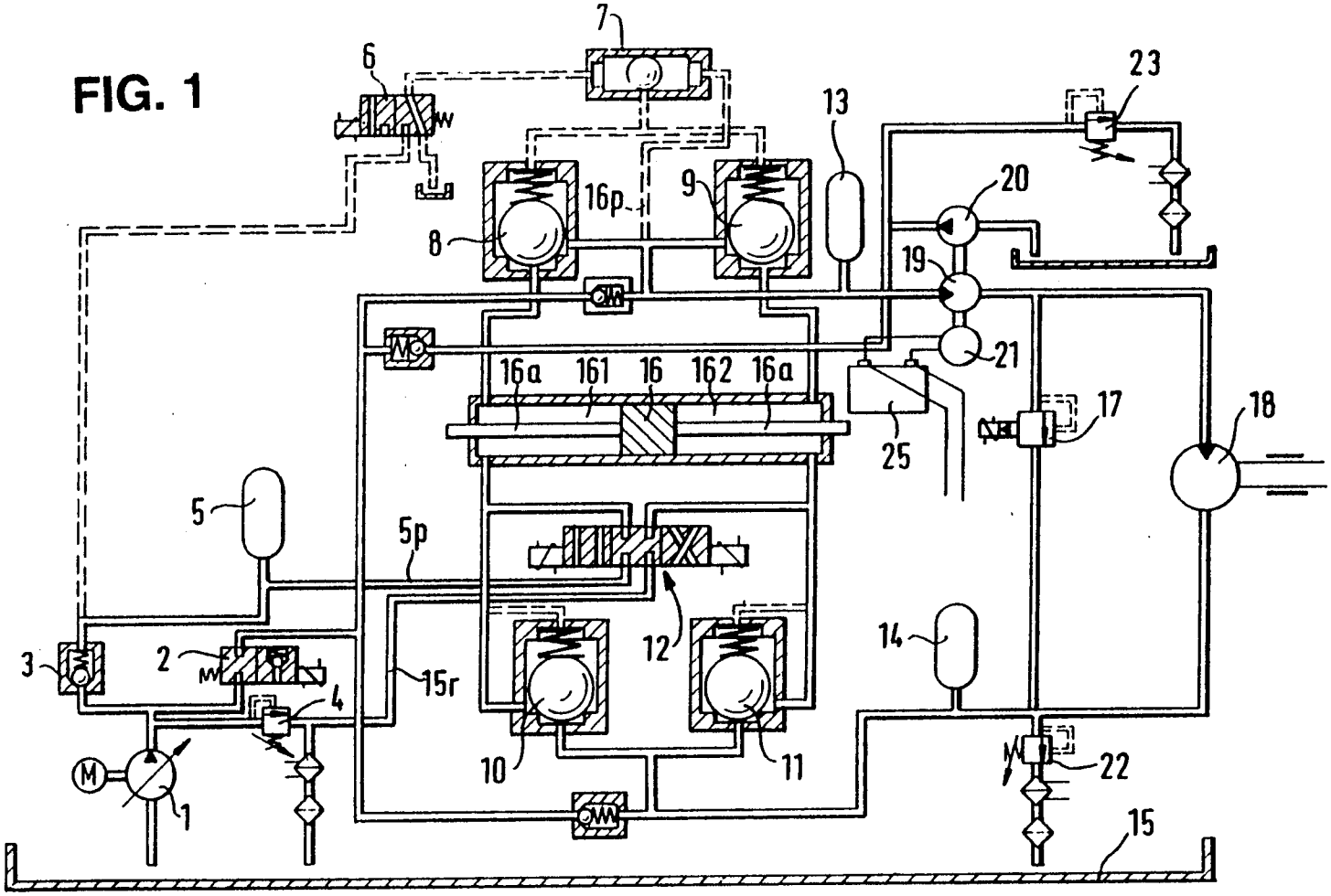
FIG. 1 shows the hydraulic circuit diagram of a starting method and apparatus in accordance with the invention.
Figure 2:
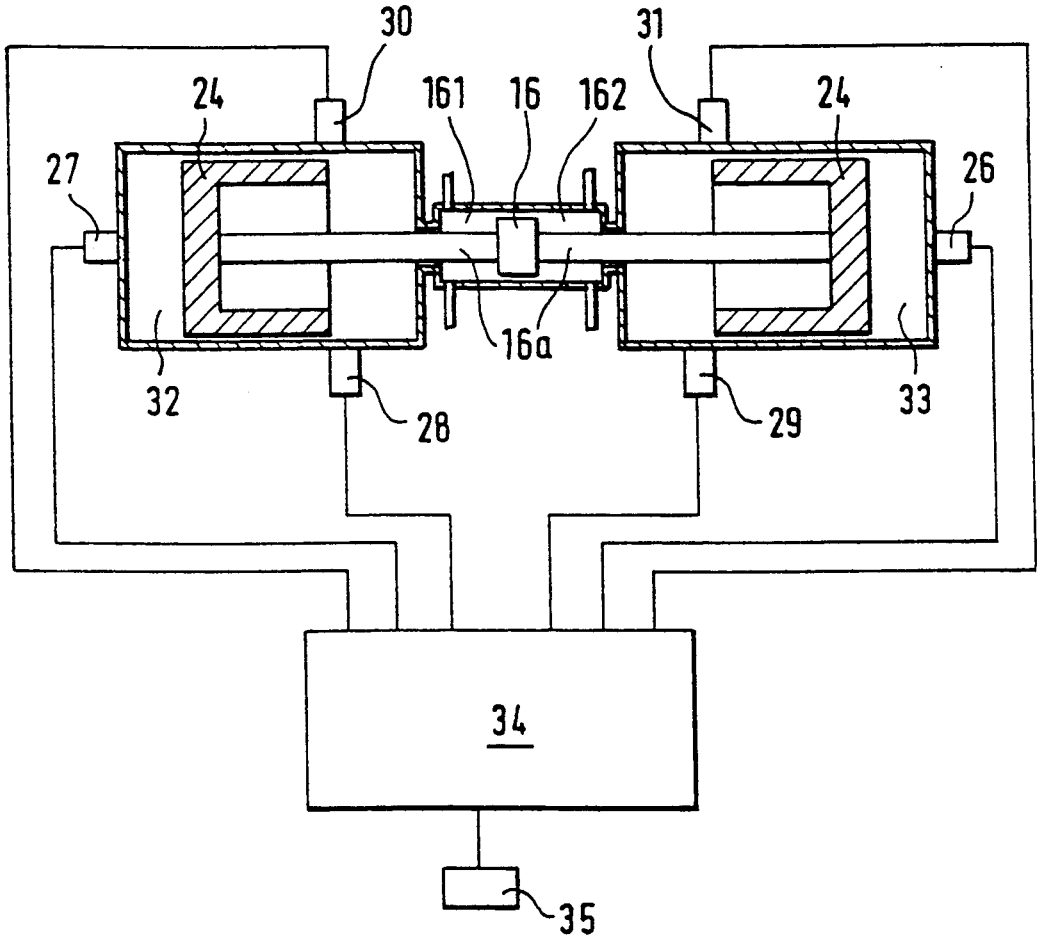
FIG. 2 shows diagrammatically the control diagram of the displacer engine and its starting sequence.

The free piston combustion employs a free reciprocating piston unit having at its center a hydraulic piston 16 connected via a piston rod 16*a* to engine pistons 24 (see FIG. 2), which are fitted to the ends of the piston rod 16*a* and reciprocate in respective combustion chambers or cylinders 32 and 33. In FIG. 1 the engine pistons are not shown, yet they should be assumed to be connected in an identical manner to the ends of the piston rod 16*a*. The hydraulic piston 16 divides the cylinder volume into two cylinder spaces 161 and 162 that act during the normal function of the engine as pump cylinders for the hydraulic power output from the engine. According to the invention the piston/cylinder device 16, 161, 162 also operates as the starting power apparatus of the engine as will be more closely described in the following description.

Preliminary operations

Using an electrically-driven auxiliary pump 1 the pressure accumulator 5 is filled via a check valve 3. The left block of the control valve 2 is activated at this stage.

The left block of the control valve 6 is next activated. As a result, the ball of the two-way check valve 7 is shifted to the right hand end, while the ball check valves 8 and 9 (check valves of the pressure side) are closed by the pressure. The valves 6 and 7 are needed for relieving load from the free piston pump during starting (acting as load relief valves).

When the pressure accumulator 5 is charged, the right hand side of the valve 2 is activated by electric control. Then, the auxiliary pump 1 acts as the flushing pump of the system.

Starting the system

The starting unit is formed by a directional valve 12 and the pressure accumulator 5. The directional valve 12 is switched between its end positions by electric control in order to achieve the conditions necessary for the combustion process. The direction change of the free piston unit takes place immediately after the engine piston has attained the top dead center at either cylinder end. For instance, when the directional valve 12 is at is left hand end (left hand end activated), the pressurized fluid flow supplied by the pressure accumulator 5 enters the left hand chamber 161 of the hydraulic pump, thereby shifting piston 16 of the piston unit to the right. The ball check valves 8 and 9 stay closed by virtue of the pressure routed from the pressure accumulator 5 via the valves 6 and 7. From the right hand chamber 162 of the hydraulic pump the fluid returns to a reservoir 15 via the directional valve 12 and the return line 15*r*. Then, the load for the free piston unit is provided by the mass of the free piston unit 16, 16*a*, 24, the compression pressure in the combustion cylinder 33 of the right hand end and the pressure loss of the return flow. Additionally, the ball check valves 10 and 11 stay closed. Next, the directional valve 12 is immediately switched to the other limit position, whereby the free piston unit motion is reversed. The pressure energy of the pressure accumulator 5, as well as the compression energy produced in the engine chamber 32 or 33 of the corresponding end during the preceding stroke, are thus made available for moving the free piston unit.

When the free piston unit 16, 16*a*, 24 has been hydraulically accelerated with sufficient energy input to attain a desired compression pressure, the fuel injection control is activated, the combustion process is initiated, and the engine begins to run under its own power.

The starting sequence of the apparatus can be altered under program control. This means that the number of displacer strokes performed from end to end during starting can be varied, the starting instant of fuel injection can be varied, the starting instant of fuel injection can be controlled (for the delay counted as in the number of strokes before the first fuel injection), and the load activation can be freely programme (to set the apparatus into the pumping mode).

Function

Upon ignition of fuel in one of the cylinders 32, 33 of the displacer engine, the right block of the valve 6 is activated, whereby the ball of the ball valve 7 (two-way check valve) is transferred to the left hand end under the pressure of the load. The ball valves 8 and 9 assume operation as outlet check valves, and the hydraulic pump commences the pumping function, thereby transferring energy into the system.

For instance, when the fuel has been ignited at the left hand end 32, the free piston unit moves to the right, and hydraulic pressure starts growing up in the right hand chamber 162 of the hydraulic pump (work stroke proceeding in the right hand chamber) toward the pressure level determined by the load. The pressurized fluid can now enter the system via pressure lines 16*p* and the ball check valve 9 following opening of the valve 9, while the ball valve 8 stays closed. Simultaneously, the inlet ball check valve 10 opens releasing hydraulic fluid to the left hand chamber 161 of the free piston pump (induction stroke proceeding in the left chamber). The inlet ball check valve 11 stays closed. The pressure level in the system (that is, the load) is determined by loading of the hydraulic motor 18, or alternatively, by the pressure level set by the pressure-regulating valve 17. This pressure level can be set fully independently of the pressure needed in the pressure accumulator 5 for the starting phase.

Upon ignition of the fuel in the cylinder at the right hand end 33, the function of the ball check valves 8, 9, 10 and 11 is opposite to that described above.

Auxiliary functions

The pressure accumulator 13 functions in the high-pressure line 16*p* as a smoothing filter for the pulsating fluid flow output from the hydraulic pump and as an energy store in the system. The set pressure of the pressure accumulator 13 is dependent on the line pressure used in the system.

The pressure accumulator 14 in the low-pressure line assures a sufficient supply of fluid to the inlet side of the hydraulic pump (in order to prevent cavitation in the hydraulic pump). The set pressure for the pressure accumulator 14 is typically approx. 30 bar.

The pressure-regulating valve 22 is adjusted to set the pressure level of the low-pressure line (30 bar).

The pressure-regulating valve 4 is adjusted to set the starting pressure level in the pressure accumulator 5. The set pressure is typically approx. 200 bar. During operation the pressure level in the flushing circuit is controlled by the pressure-regulating valve 22.

A compact hydraulic motor 19 (in series with the hydraulic motor 18 functioning as the actuator) provides the drive for an electric generator 21 and a flushing pump 20. The generator 21 charges energy into an electric storage battery 25, said battery further supplying energy for the rotation of the electric drive motor of the auxiliary pump 1. The flushing pump 20 serves for system flushing and compensation of leaks. When the flushing pump 20 is functioning, the auxiliary pump 1 can be stopped. The flushing circulation is then provided by the hydraulic pump 20. Correspondingly, the pressure-regulating valve 4 becomes non-functional, and the pressure level (approx. 35 bar) of the flushing circulation is then set by the pressure-regulating valve 23.

The rotational direction of the hydraulic motor 18 is determined by an electrically controlled, proportionally functioning directional valve (not shown).

CONTROL FUNCTION

Initial condition

A microcontroller 34 (see FIG. 2) senses from the signals of sensors 30 and 31 at which end 32 or 33 the free piston unit 16 is residing. The possible center position can also be sensed. The detected position of the free piston unit 16 is stored in the microcontroller memory.

Starting sequence

Initially, the microcontroller 34 is in a dormant state waiting for a start command. After receiving this command, the microcontroller reads the pressure of the starting accumulator 5, and if it detects an inadequate pressure, activates the left hand block of the valve 2, whereby the pump 1 raises the pressure of the accumulator 5 to a sufficient level. Next the microcontroller 34 activates the left hand block of the releasing valve 6 in order to keep the valves 8 and 9 closed. Using information acquired about the position of the piston unit 16, the microcontroller 34 issues a drive signal to the valve 12 appropriate to cause piston 16 to move towards that end 32 or 33 which is farthest from the present piston position. After the piston unit has been set into motion, the microcontroller 34 monitors the crossing of the center point from the sensor signals 30 and 31, and at the occurrence of the crossing, extends the direction drive signal of the valve 12 for the duration of a preset delay, and when the delay has elapsed, issues a drive signal to the valve 12 to cause piston 16 to reverse its direction of movement and to move in the opposite direction. During the motion of the free piston unit 16, the microcontroller 34 computes the speed of the free piston unit at the center point from the time difference between the signals from sensors 28 and 29. As a final check, the microcontroller 34 verifies the crossing of the center point from the signals from sensors 30 and 31, computing thereafter the hold delay for the direction control signal of the valve 12. Depending on the attained speed of the free piston unit 16 at the center point, the microcontrntroller 34 decides whether to initiate the combustion process at that end position towards which the free piston unit is approaching. If a sufficient inertial energy has been attained, the microcontroller 34 initiates the combustion process at a point computed from the signals from sensors 28, 29, 30 and 31. The microcontroller 34 sets the valve 6 to the pumping position (allowing the pump check valves 8 and 9 to open) at a programmable instant preceding the initiation of the combustion process. Upon a successful starting of the engine, the microcontroller 34 sets the valve 12 to the center position and commences the control and regulation of the normal operation of the engine.

The microcontroller 34 is designed for the integrated control of all electrically controlled actuators of the system. A stop switch 35 is provided for the shut-off of the engine.

Figure 3:
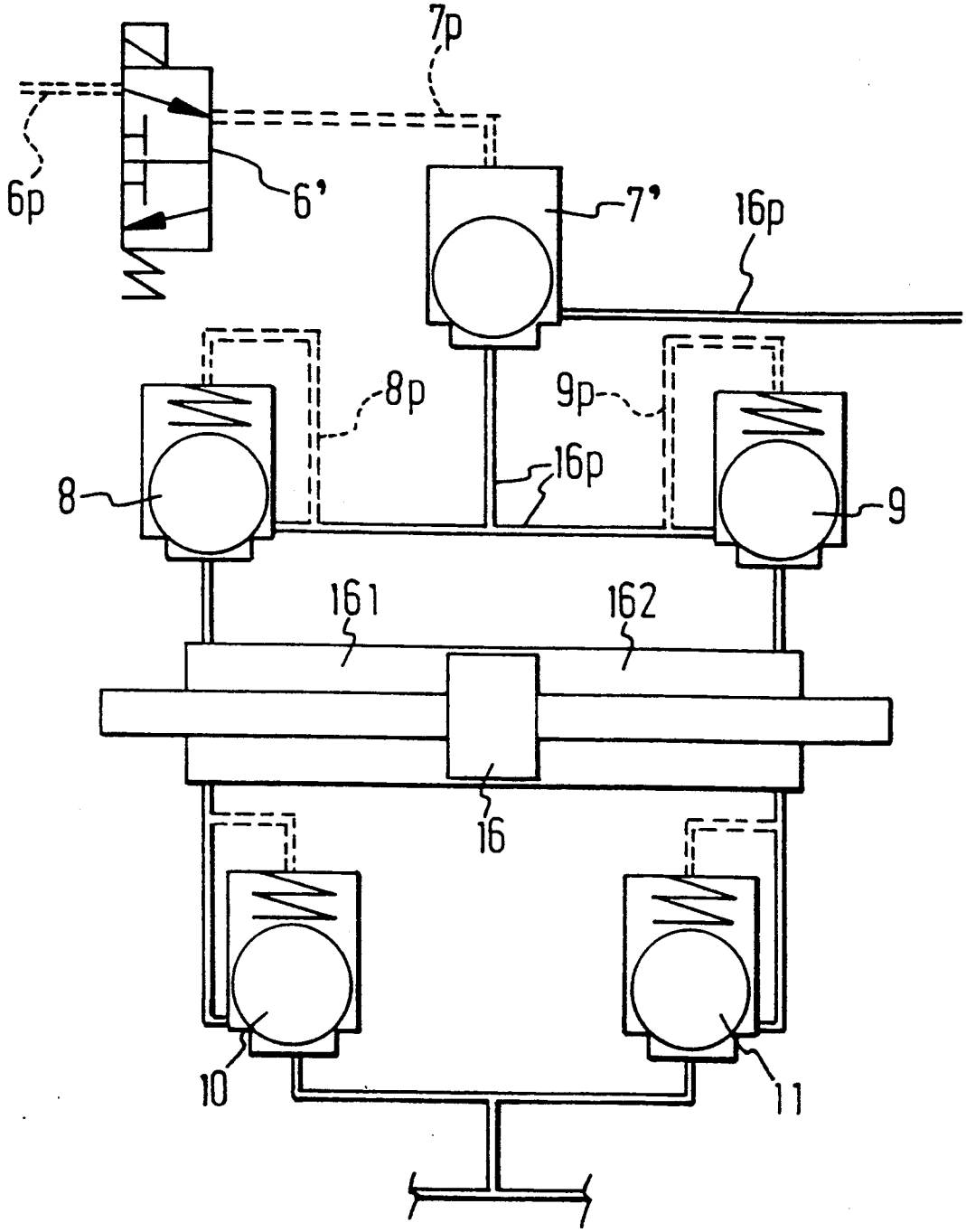
FIG. 3 shows the most essential part of the hydraulic circuit diagram of the starting method and apparatus in accordance with an alternative embodiment of the invention.

The embodiment of FIG. 3 differs from that of FIG. 1 in that the two-way check valve 7 is replaced by a one-way check valve 7' having a pressure control port for the control pressure line **7*p* from the control valve 6'. There are further differences in that the output pressure line 16*p* is connected to the load through the check valve 7', and the check valves 8 and 9 have their closing control ports connected via control lines 8*p* and 9*p* to the load pressure line 16*p* between the check valves 8, 9 and 7'. When the valve 6' is switched to the position shown, the control pressure from lines 6*p* and 7*p* acts on the top of the ball in the check valve 7', thereby closing the check valve 7', which closes the output pressure line 16*p*. The pressure in the pressure line 16*p* between the check valves 8, 9 and 7' closes the check valves 8 and 9 via lines 8*p* and 9*p* respectively. The check valves 8 and 9 remain closed, irrespective of any pressure in the cylinders 161 and 162, until the position of the control valve 6' is changed to relieve the control pressure from the check valve 7'. This embodiment has the advantage that all the check valves 8, 9, 10 and 11** may have the same construction.

The control pressure line **6*p* is connected to the pressure accumulator 5 (as in FIG. 1) for starting the engine. The method and apparatus according to the present invention is applicable also in the case that there are not separate pressure accumulators 5 and 13** for starting the engine and feeding the load, but these high pressure accumulators can be combined into one accumulator in many appliances.

In the above description, the "free piston unit" comprises two opposite engine pistons and at least one double-acting hydraulic piston fitted to the same reciprocating piston rod.

Obviously, the invention is not limited to the exemplifying embodiments described above. For instance, a twin set of single-acting piston/cylinder pumps in a boxer arrangement could form the double-acting hydraulic pump disclose in this description and the subsequent claims.

What is claimed is:

1. A free piston combustion engine comprising:

body means defining a pair of opposed combustion cylinders;

a combustion piston reciprocably disposed in each said combustion cylinder for reciprocal motion therein;

piston rod means connecting said combustion pistons one to another whereby said combustion pistons may reciprocate in unison in their respective combustion cylinders;

hydraulic power output means including at least one pair of hydraulic cylinder spaces having an associated hydraulic piston reciprocably disposed therein, said hydraulic piston being operatively linked to said piston rod so as to reciprocate in unison therewith;

hydraulic accumulator means for storage of hydraulic fluid under elevated pressure for use in starting said engine;

hydraulic inlet check valves for controlling inlet of hydraulic fluid to each said hydraulic cylinder space, said hydraulic inlet check valves each including a first check valve member movable between a first position in which it permits inlet of hydraulic fluid to its respective hydraulic cylinder and a second position in which it prevents inlet of hydraulic fluid thereto;

first hydraulic control means connected between said hydraulic accumulator means and said hydraulic cylinder spaces for controlling flow of hydraulic fluid from said hydraulic accumulator means to said hydraulic cylinder spaces during starting of said engine, said first hydraulic control means including a directional valve means permitting, in one condition thereof, inlet of hydraulic fluid from said hydraulic accumulator means to one of a respective pair of hydraulic cylinder spaces and outlet of hydraulic fluid from the other one thereof and permitting, in another condition of said directional valve means, inlet of hydraulic fluid from said hydraulic accumulator means to said other hydraulic cylinder space of said pair and outlet of hydraulic fluid from said one hydraulic cylinder space of said pair;

hydraulic outlet check valves for controlling outlet of hydraulic fluid from each said hydraulic cylinder space, said hydraulic outlet check valves each including a second check valve member movable between a first position in which it permits outlet of hydraulic fluid from its respective hydraulic cylinder space to an output supply line and a second position in which it prevents outlet of hydraulic fluid from its respective hydraulic cylinder space; and second hydraulic control means connected between said hydraulic accumulator means and said hydraulic outlet check valves arranged to permit application of an elevated control pressure to said second check valve members so as to move them each to its respective said second position to prevent outlet of hydraulic fluid from its associated hydraulic cylinder space during starting of said engine so long as the pressure within said associated hydraulic cylinder space does not exceed said elevated control pressure;

said first hydraulic control means being arranged to permit, during starting of said engine, by repeated switching of said directional valve means between said first and second conditions thereof, hydraulic fluid to enter each of said pair of hydraulic cylinder spaces in turn from said hydraulic accumulator means thereby to impart reciprocal motion to said piston rod and to said combustion pistons so as to produce in said combustion cylinders in turn a desired compression pressure at which combustion can be initiated therein; and said second hydraulic control means being arranged so that, at a predetermined moment after said piston rod together with said pistons begins to reciprocate, said control pressure is removed from said second check valve members to permit outlet of hydraulic fluid from said hydraulic cylinder spaces.

2. A free piston combustion engine according to claim 1, wherein said hydraulic power output means comprises a double-acting piston and cylinder arrangement including a single piston slidable within a common cylinder and dividing said common cylinder into said pair of opposed said hydraulic cylinder spaces.

3. A free piston combustion engine according to claim 1, wherein said hydraulic power output means comprises a pair of single-acting piston/cylinder pumps in a boxer arrangement.

4. A free piston combustion engine according to claim 1, wherein said second hydraulic control means includes a control valve having a first inlet connected to said hydraulic accumulator means, a second inlet connected to said output supply line, and an outlet connected to said hydraulic outlet check valves, said control valve including a check valve member movable between a first end position in which it permits communication between said first inlet and said outlet to permit application of hydraulic pressure from the hydraulic accumulator means to said second check valve members to bias them towards their respective second positions and a second end position in which it permits communication between said second inlet and said outlet to permit the pressure on the two sides of the said second check valve members substantially to equalise to permit free movement thereof between their respective said first and second positions.

5. A free piston combustion engine according to claim 4, wherein each said hydraulic outlet check valve further comprises spring means resiliently biasing said second check valve member towards its second position whereby said control pressure is provided by a combination of hydraulic pressure from said hydraulic accumulator means and spring pressure provided by said spring means.

6. A free piston combustion engine according to claim 1, wherein said output supply line is provided with a hydraulic motor arranged to drive an electric generator and a flushing pump.

7. A free piston combustion engine according to claim 1, wherein said first hydraulic control means and said second hydraulic control means are under the control of an electronic controller which is connected to sensors arranged to sense the speed and position of said free piston unit.

8. A free piston combustion engine according to claim 7 wherein said electronic controller is arranged to initiate fuel injection at a moment which is selected from the moment at which said free piston unit has completed a preset number of reciprocating movements and the moment at which said free piston unit has attained a predetermined magnitude of inertial energy and wherein said electronic controller is arranged to disable said first hydraulic control means and stop switching of said directional valve means between its first and second positions at a second moment selected from said first moment, a moment immediately before said first moment, and a moment immediately after said first moment, thereby to permit said hydraulic cylinder spaces to receive hydraulic fluid via said hydraulic inlet check valve means from a reservoir for hydraulic fluid.

9. A free piston combustion engine according to claim 1, wherein a further pressure accumulator means is connected to said output supply means and wherein said hydraulic accumulator means can be pressurized to a higher pressure than the pressure in said further pressure accumulator means.

10. An internal combustion assisted hydraulic engine comprising:

body means defining a pair of opposed combustion chambers;

a combustion piston reciprocably disposed in each said combustion chamber for reciprocal motion therein;

a piston rod rigidly connecting said combustion pistons to cause said combustion pistons to reciprocate in their respective combustion chambers in unison with said piston rod as a free piston unit;

at least one double-acting hydraulic pump comprising a pair of hydraulic cylinder spaces with a hydraulic piston reciprocably disposed therein, said hydraulic piston or pistons being operatively connected to said piston rod to move in unison therewith;

a reservoir for hydraulic fluid;

an output pressure line for supply of hydraulic fluid under pressure to a hydraulic actuator;

hydraulic accumulator means for storage of hydraulic fluid under pressure for starting said engine;

hydraulic inlet check valves for controlling inlet of hydraulic fluid to said hydraulic cylinder spaces, each said hydraulic inlet check valve including a first check valve member movable between a first position in which it permits inlet to its respective cylinder space of hydraulic fluid from said reservoir and a second position in which it prevents inlet of hydraulic fluid to its respective hydraulic cylinder space;

hydraulic outlet check valves for controlling outlet of hydraulic fluid from said hydraulic cylinder spaces, each said hydraulic outlet check valve including a second check valve member movable between a first position in which it permits outlet of hydraulic fluid from its respective hydraulic cylinder space to said output pressure line, and a second position in which it prevents outlet of respective hydraulic fluid from said hydraulic cylinder space to said output pressure line;

first hydraulic control means connected between said hydraulic accumulator means and said hydraulic cylinder spaces and including a directional valve means permitting, in one condition thereof, inlet of hydraulic fluid from said hydraulic accumulator means to one hydraulic cylinder space of the or a said pair of hydraulic cylinder spaces and outlet of hydraulic fluid from the other hydraulic cylinder space of the respective pair of hydraulic cylinder spaces to said reservoir and, in another condition thereof, outlet of hydraulic fluid from said one hydraulic cylinder space to said reservoir and inlet of hydraulic fluid to said other hydraulic cylinder space from said hydraulic accumulator means; and second hydraulic control means for applying, during starting of said engine, a hydraulic control pressure to said second check valve members to bias them each towards its respective second position to prevent outlet of hydraulic fluid from its associated hydraulic cylinder space to said output pressure line so long as the pressure biasing said second check valve members towards their respective second positions exceeds the pressure within said associated hydraulic cylinder space;

said first hydraulic control means being arranged so that, during starting of said engine, said directional valve means is repeatedly switched between its first and second positions to pressurize the hydraulic cylinder spaces of the or each said pair of hydraulic cylinder spaces in turn thereby to cause reciprocation of said free piston unit until a desired compression pressure has been achieved in a respective said combustion chamber sufficient to permit initiation of the combustion process therein; and said second hydraulic control means being arranged so that, at a desired instant after said piston unit begins to reciprocate, said hydraulic control pressure is released to permit hydraulic fluid to flow from said hydraulic cylinder spaces to said output pressure line.

11. An internal combustion assisted hydraulic engine according to claim 10, wherein said double-acting hydraulic pump means comprises a piston movable within a common cylinder and dividing said common cylinder into a pair of hydraulic cylinder spaces.

12. An internal combustion assisted hydraulic engine according to claim 10, wherein said at least one double-acting hydraulic pump means comprises a twin set of single-acting piston/cylinder pumps in a boxer arrangement.

13. An internal combustion assisted hydraulic engine according to claim 10, wherein said output pressure line is provided with a low power hydraulic motor arranged to drive an electric generator and a flushing pump.

14. An internal combustion assisted hydraulic engine according to claim 10, wherein said first hydraulic control means and said second hydraulic control means are arranged to be controllable by an electronic controller which is connected to sensors sensing the speed and position of free piston unit.

15. An internal combustion assisted hydraulic engine according to claim 10, wherein said electronic controller is arranged to initiate fuel injection at a first instant which is selected from the instant at which said free piston unit has completed a preset number of reciprocating movements and the instant at which said free piston unit has attained a predetermined magnitude of an inertial energy, said electronic controller further being arranged to disable said first hydraulic control means at a second instant which is selected from said first instant, an instant immediately before said first instant, and an instant immediately after said first instant, thereby to permit hydraulic fluid to be drawn from said reservoir into said hydraulic cylinder spaces via said hydraulic inlet check valves.

16. An internal combustion assisted hydraulic engine according to claim 10, wherein a pressure accumulator means is connected to said output pressure line, said hydraulic accumulator means being arranged to be pressurized to a higher pressure than said pressure accumulator means.

17. An internal combustion assisted hydraulic engine according to claim 10, wherein said second hydraulic control means includes a control valve having a first inlet which can be placed in fluid communication with said hydraulic accumulator means, a second inlet in fluid communication with said output supply line, and an outlet in fluid communication with said hydraulic outlet check valves, said control valve including a check valve member movable between a first control position in which it permits fluid communication between said first inlet and said outlet to permit application of hydraulic pressure from said hydraulic accumulator means to said second check valve members to bias them towards their respective second positions and a second control position in which it permits communication between said second inlet and said outlet to permit the pressure on the two sides of said second check valve members to equalise to permit free movement thereof between their respective first and second positions and wherein said hydraulic control means further includes means for interrupting communication between said hydraulic accumulator means and said first inlet.

18. An internal combustion assisted hydraulic engine according to claim 17, wherein each said hydraulic outlet check valve further comprises spring means resiliently biasing said second check valve member towards its second position whereby said pressure biasing said second check valve member towards its second position during starting of said engine comprises the sum of said hydraulic control pressure and spring pressure provided by said spring means.

19. A method of starting an internal combustion assisted hydraulic engine having a pair of opposed combustion chambers, a combustion piston reciprocably disposed in each said combustion chamber and linked one to another by a piston rod to form a free piston unit, at least one double-acting hydraulic pump comprising a pair of hydraulic cylinder spaces with a hydraulic piston reciprocably disposed therein, said hydraulic piston or pistons being operatively connected to said piston rod to move in unison therewith, one way inlet check valves for controlling inlet of hydraulic fluid from a reservoir to said hydraulic cylinder spaces, one way outlet check valves for controlling outlet of hydraulic fluid from said hydraulic cylinder spaces, each said one way valve including a check valve member movable under the influence of a control pressure applied thereto between a first end position permitting flow of hydraulic fluid through said check valve and a second position preventing flow of hydraulic fluid through said check valve, said method comprising the steps of:

providing a hydraulic accumulator means pressurized to an elevated pressure for starting said engine;

connecting said hydraulic accumulator means to said one way outlet check valves so as to apply the pressure prevailing in said hydraulic accumulator means as an elevated hydraulic control pressure to said check valve members thereof to close said one way outlet control valves;

supplying hydraulic fluid from said hydraulic accumulator means to each of said hydraulic cylinder spaces of the or a said respective pair of said hydraulic cylinder spaces in turn thereby to pressurize said hydraulic cylinder spaces in turn and to impart a reciprocating motion to said free piston unit; and disconnecting said hydraulic accumulator means from said one-way outlet check valves so as to remove the elevated hydraulic control pressure from said check valve members thereof thereby to permit opening of said one way outlet check valves at a moment selected from a first moment at which the combustion process is initiated, a second moment immediately preceding said first moment, and a third moment immediately following said first moment.

20. A method according to claim 19, wherein closure of said one-way outlet check valves is assisted by application of spring pressure from spring means arranged to bias said respective check valve members towards their closed positions.

21. A method according to claim 19, wherein the step of alternatively pressurizing said hydraulic cylinder spaces includes the step of switching a directional valve between end positions permitting flow of hydraulic fluid into one said cylinder hydraulic space and out from the other said hydraulic cylinder space of the or a said pair of hydraulic cylinder spaces while said piston unit is moving in one direction and allowing inlet of hydraulic fluid to said other hydraulic cylinder space and outlet of hydraulic fluid from said one hydraulic cylinder space when said piston unit is moving in the other direction, switching of said directional valve being under control of an electronic controller in dependence upon information about the position and speed of said free piston unit derived by said controller from signals from sensors mounted in the engine.

22. A method according to claim 19, wherein initiation of the combustion process in said combustion chambers is effected after a first predetermined time from initiating starting of said engine, said predetermined time being selected from a time period required for said free piston unit to complete a preset number of reciprocating movements and a time period sufficient for the free piston to attain a predetermined magnitude of inertial energy, and wherein, after a second predetermined time from initiation of the starting procedure, said second time being selected from said first predetermined time, a time interval slightly shorter than said first predetermined time, and a time period slightly longer than said first predetermined time, the step of alternately pressurizing said hydraulic cylinder spaces from said hydraulic accumulator means is terminated, thereby allowing hydraulic fluid to be drawn from said reservoir into said hydraulic cylinder spaces via said one-way inlet check valves.

* * * * *